United States Patent [19]

Reiter et al.

[11] Patent Number: 4,625,893

[45] Date of Patent: Dec. 2, 1986

[54] STAMP BOOKLET DISPENSER MECHANISM

[75] Inventors: Eli Reiter, Dix Hills; Joseph R. Robson, Smithtown; Joseph W. Latinski, Commack, all of N.Y.

[73] Assignee: General Aero Products Corp., Copiague, N.Y.

[21] Appl. No.: 668,198

[22] Filed: Nov. 5, 1984

[51] Int. Cl.[4] ..... G07F 11/04

[52] U.S. Cl. ..... 221/67; 221/279; 221/281; 221/297; 414/126

[58] Field of Search ..... 221/67, 118, 279, 289, 221/297, 312 R, 312 C, 54, 198, 281; 414/126; 312/50, 60

[56] References Cited

U.S. PATENT DOCUMENTS

| | | | |
|---|---|---|---|
| 495,241 | 4/1893 | Braun | 221/67 |
| 3,710,976 | 1/1973 | Guidi et al. | 221/67 |
| 3,773,223 | 11/1973 | Guidi et al. | 221/67 |
| 4,350,264 | 9/1982 | Muller | 221/67 |

*Primary Examiner*—H. Grant Skaggs

*Assistant Examiner*—Edward S. Ammeen

*Attorney, Agent, or Firm*—Gottlieb, Rackman & Reisman

[57] ABSTRACT

A postage stamp booklet dispenser mechanism uses a multi-position gate cam, which rotates about a central axis and controls the opening and closing of opposed pairs of gate members through which the stamp booklets are dispensed. The operative followers of each pair of gates alternately move between dwell and rest positions to thereby provide corresponding open and closed modes of operation, resulting in the selective dispensing of single booklets from a criss-cross stack. By disposing one pair of gate members in a position slightly offset from the gate cam's central axis, one of the gate members of that pair receives a slight preferential opening position to insure that the booklet dispensed when that pair of gates is opened, falls in the proper orientation onto the chute of the dispenser mechanism. Between each dispensing cycle, all four gates return to their rest positions to prevent inadvertent dispensing and "jackpotting" of the entire stored group of booklets.

10 Claims, 13 Drawing Figures

FIG.6
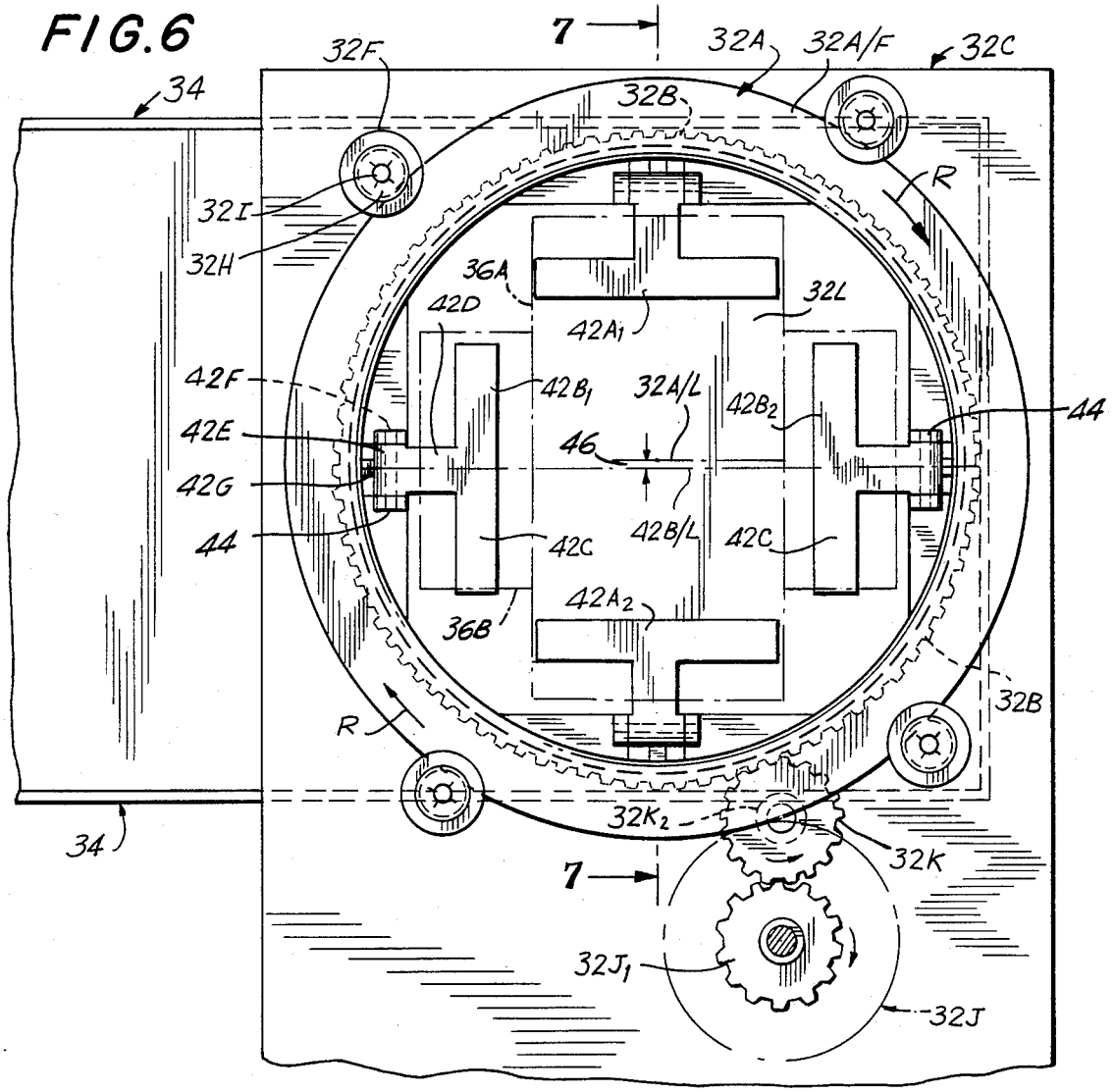
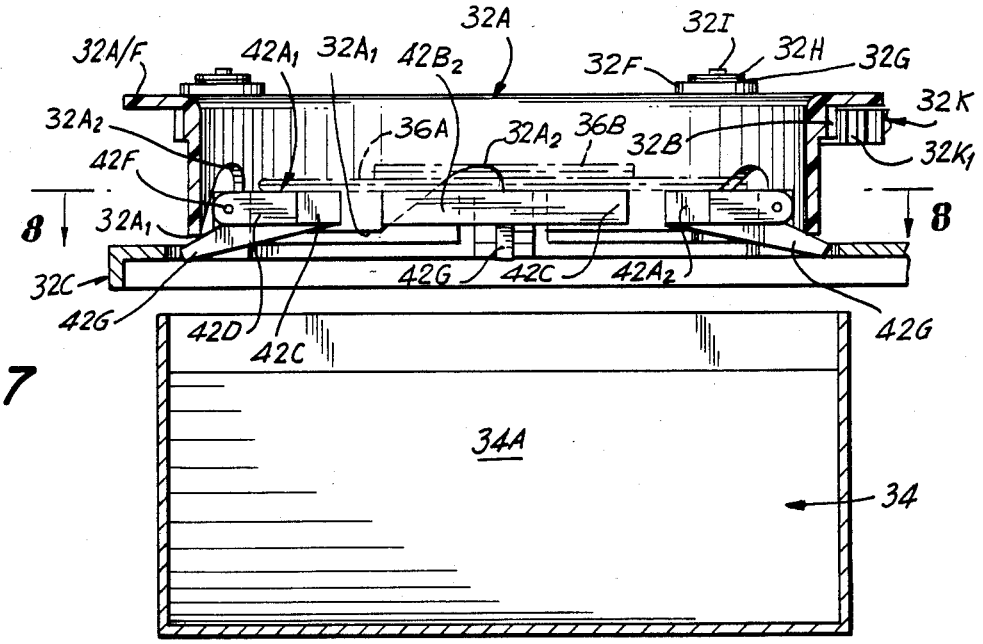
FIG.7

STAMP BOOKLET DISPENSER MECHANISM

DESCRIPTION

This invention relates to dispensing equipment in general, and to a machine which selectively dispenses postage stamp booklets in particular.

In contemporary life, there are numerous items which are purchased by the consuming public through the use of machines or other impersonal devices or arrangements. This fairly commonplace activity is merely reflective of the need for access to retail merchandise on a continuous basis, often at irregular hours. Moreover, unattended sales are generally desirable because of their labor-saving aspects and basically trouble-free operation.

There are many situations where mechanized dispensing is utilized, to the mutual advantage of all concerned. Areas of commercial activity where this has already occurred include food products, cosmetics, financial institutions and a variety of miscellaneous fields which have in common the need for selectively dispensing non-perishable merchandise under suitably controlled conditions.

Among the parameters which usually must be monitored in automatic dispensing equipment are such factors as the number of units to be dispensed, the insertion of the proper amount of money, the avoidance of errors (e.g., multiple dispensings) and the temporary cessation of operation when the supply of merchandise is exhausted. But probably no single design element of these devices has received more attention than the actual distribution and delivery mechanism itself, governing just how the item is ultimately presented to the purchaser.

There has been no lack of activity among designers in trying to arrive at the "ideal" dispensing mechanism, for example with regard to vendable items like flat, rectangular booklets which are conventionally used to contain postage stamps. These booklets are relatively thin and are bound at one end, and are therefore readily capable of being "stacked" for storage and dispensing purposes. This relatively straightforward geometrical fact has been recognized by the prior art, leading to the accepted "criss-cross" stacking of such booklets to thereby establish a mode for alternate dispensing from each group in the stack.

Thus, the general approach of the prior art has been to stack these rectangular booklets in alternating orthogonal orientation, thereby forming an overall cruciform package, which is positioned in an appropriately shaped receptacle. Although a number of dispensing techniques have also been developed, the alternate criss-cross stacking configuration has generally led to use of a gravity-feed arrangement, coupled with some equipment to insure that only one booklet is dispensed at a time. However, despite the progress that has been made in the foregoing developments, certain problems still remain unresolved or unaddressed.

One area which has not been adequately attended to is the long-range life of the control elements in the dispensers. For example, while measured dispensing such as by using cams and cam followers has been utilized heretofore, it has been assumed that only a very few item can be dispensed for each cyclical movement of the cam (e.g., through a full rotation). Little or no consideration has been given to the very important concept of maximizing the number of dispensing positions effected through a given cycle of movement of a cam. This design omission can eventually result in more cam movement being required to provide relatively few dispensings, not to mention the shorter structural life of mechanisms which must labor harder to achieve a particular result.

Another problem that arises with prior art equipment is the jamming of machines by the improper or uncontrolled ejecting of booklets, with no way to monitor the sequence or direction in which the booklets move. In a gravity-feed system, a slanted chute is often used to receive and then deliver a selected booklet to the purchaser. As the booklet leaves the internal dispenser, presumably under some control, it does not always arrive at the uppermost lip of the chute, and occasionally falls back toward the dispenser and jams it, or else drops to the floor of the chassis of the machine without ever being fully dispensed. The consumer has conceivably "lost" his money, and the equipment will ultimately require servicing to remove and reload the errant booklet.

And even where some of these problems have been considered and perhaps even partially solved, another aspect of continuous and selective dispensing has been overlooked, namely the inadvertant discharging of the entire load of booklets. This condition, which may occur when the control mechanism is between regular discharge positions, is known as "jackpotting", and also requires the scrutiny of contemporary designers.

It is therefore an object of this invention to obviate one or more of the aforesaid difficulties.

It is another object of this invention to maximize the number of dispensing positions achieved in a given cycle of operation.

It is also an object of this invention to control the dispensing of postage stamp booklets by using a circular gate cam having multiple lobes and dwell positions;

It is a further object of this invention to provide a preferred orientation to one end of a stamp booklet to insure the proper dispensing configuration for the booklet.

It is still another object of this invention to furnish control of booklet dispensing equipment to avoid mass discharging of stored booklets.

GENERAL DESCRIPTION

These and other objects and advantages of the invention will become apparent when a particular illustrative embodiment thereof is considered, wherein a postage stamp booklet dispenser mechanism is provided as the main operative component of a stamp booklet vending machine. The stamp booklets, stacked in criss-cross fashion and loaded into a magazine which is mounted over the dispensing equipment, is controlled by the operation of a circular cam wheel which, through its rotational cycle, acts to alternatively open and close various gate members by pairs. This is accomplished by the provision of a cam profile having multiple sets of lobe and dwell positions, with the release gates of the dispenser being opened when certain portions of the gates encounter the dwell positions of corresponding cam elements, and with the gates being closed when they encounter corresponding lobe positions on the cam.

The booklets are loaded in a criss-cross fashion, i.e., with alternating booklets being perpendicular to each other throughout the stack, preferably as is disclosed in copending application Ser. No. 668,204, filed contemporaneously herewith. The booklet magazine is correspondingly cruciform in cross-section to accommodate the loading of the criss-cross stack of booklets, which are fed by gravity downward into the dispensing area of the unit, assisted by the placement on top of the stack of a removable cruciform weight member.

During operation, and when appropriately activated by the insertion of the requisite coin amount, the cam moves through a portion of its rotation so that an opposed pair of underlying gate members can occupy opposite raised dwell positions on the cam member. Upon encountering the dwell positions in a given sequence, the gates rotate downward and thereby open up one of the two opposed "bays" to allow the appropriately oriented booklet at that location to be dispensed in a vertical, gravityfeed manner. The booklet then drops down onto a delivery chute and is provided to the consumer through an opening on the front of the machine. As the same cycle continues, the further movement of the cam causes the previously open gates to be closed as the follower portion of each cam travels toward the flat lobe of the cam to thereby maintain the previously opened gate pair in a closed position. At this point in time, both opposed gate pairs are closed and this will constitute the "rest" position for the system prior to another dispensing cycle. This advantageous arrangement, whereby all four gates (two pairs of two each) remain closed, is very desirable in machines of this type in order to avoid accidental dispensing of the entire load of vendable items, occasionally known as "jackpotting" in this technology.

One of the problems alluded to earlier is the possibility that in at least some dispensing cycles, the sequence or orientation of the item to be dispensed will not be sufficiently certain or affirmative to insure that it passes down to the dispensing chute and out to the consumer in the proper manner. These prior art problems related primarily to the possible inadvertent or improper tilting or slanting of the postage stamp booklet after it has been properly dropped from the stack during the dispensing cycle. But if the booklet does not move to the chute in the proper orientation, it may become "hung up" on the upper lip of the chute and conceivably jam the mechanism.

The present invention also attends to this problem by providing a preferential sequence for the dispensing of booklets in one of the two orthogonal orientations. (The other orientation does not require preferential treatment, since it is dropping its booklet laterally across the principal dimension of the chute and therefore the sequence or delivery direction for that booklet is not as critical as for the opposite one.) In order to establish the preferred dropping sequence, it is desirable to provide one of the two gates in the preferred pair with an "advance" dropping mode, whereby in the course of rotation of the controlling cam, that gate becomes operative to drop down into the "bay" prior to its opposed gate element in the same pair. As a result of this feature, the stamp booklet which is resting on that pair of gate elements follows the preferred dropping sequence so that the end of the booklet which is resting on the preferred advance gate member drops down into the chute first, followed shortly thereafter by the other end of the booklet. In so doing, the booklet is assured of falling into the chute in a selected and desirable dispensing orientation, following a discontinuous dropping motion.

This predetermined sequence is achieved by having that pair of opposed gate elements disposed with its center line slightly offset from the center line of the gate cam itself. In this manner, as the gate cam rotates and is about to activate that particular pair of gates for a dispensing step one of the two gates in the pair will drop down first because its follower portion will reach the dwell position of that particular cam segment slightly prior to its corresponding opposed gate member; then, after the preferred gate has dropped down, the continuation of the cycle will result in the second gate of the pair also dropping down, insuring the full dispensing of the booklet, but in the desired sequence described above. Of course, as the cycle continues to operate and prior to its conclusion, both of these gate members are then raised back to their rest positions, by their followers encountering the lobes of the gate cam, again establishing the four-way hold or protection position to avoid jackpotting and waiting for the next cycle to commence.

It is therefore a feature of an embodiment of this invention that a circular and rotatable cam interacts with multiple pairs of opposed gate members to dispense corresponding longitudinally oriented and criss-cross stacked booklets in a desired sequence.

It is another feature of an embodiment of this invention that the dwell or release positions of a circular cam member correspond to respective pair of opposed gate elements, with the cam furnishing a release command to the gate pairs every 30° of rotation of the cam.

It is also a feature of an embodiment of this invention that one pair of gate elements located proximate to the discharge chute of the unit is arranged with its center line slightly offset relative to the central axis of the cam, to cause one of the two gate elements to release slightly ahead of its counterpart during the cam's rotational cycle.

It is still a further feature of an embodiment of this invention that between dispensing cycles, all of the gate elements are in the up or closed position to provide a stable support for the stacked booklets and to prevent accidental dispensing of all stored booklets.

Additional objects, features and advantages of this invention will become more readily undestood when considered in conjunction with a presently preferred, but nonetheless illustrative, embodiment of the invention that is explained in the following detailed description and as shown in the accompanying drawing, wherein.

Figure 1:
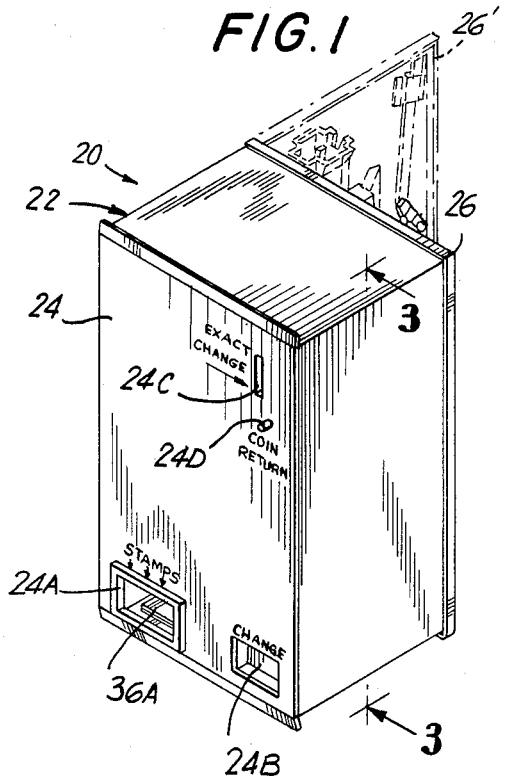
FIG. 1 is a perspective view of the outside housing of the dispensing machine, showing the front panel and indicating in phantom lines the opening of the rear door.
Figure 3:
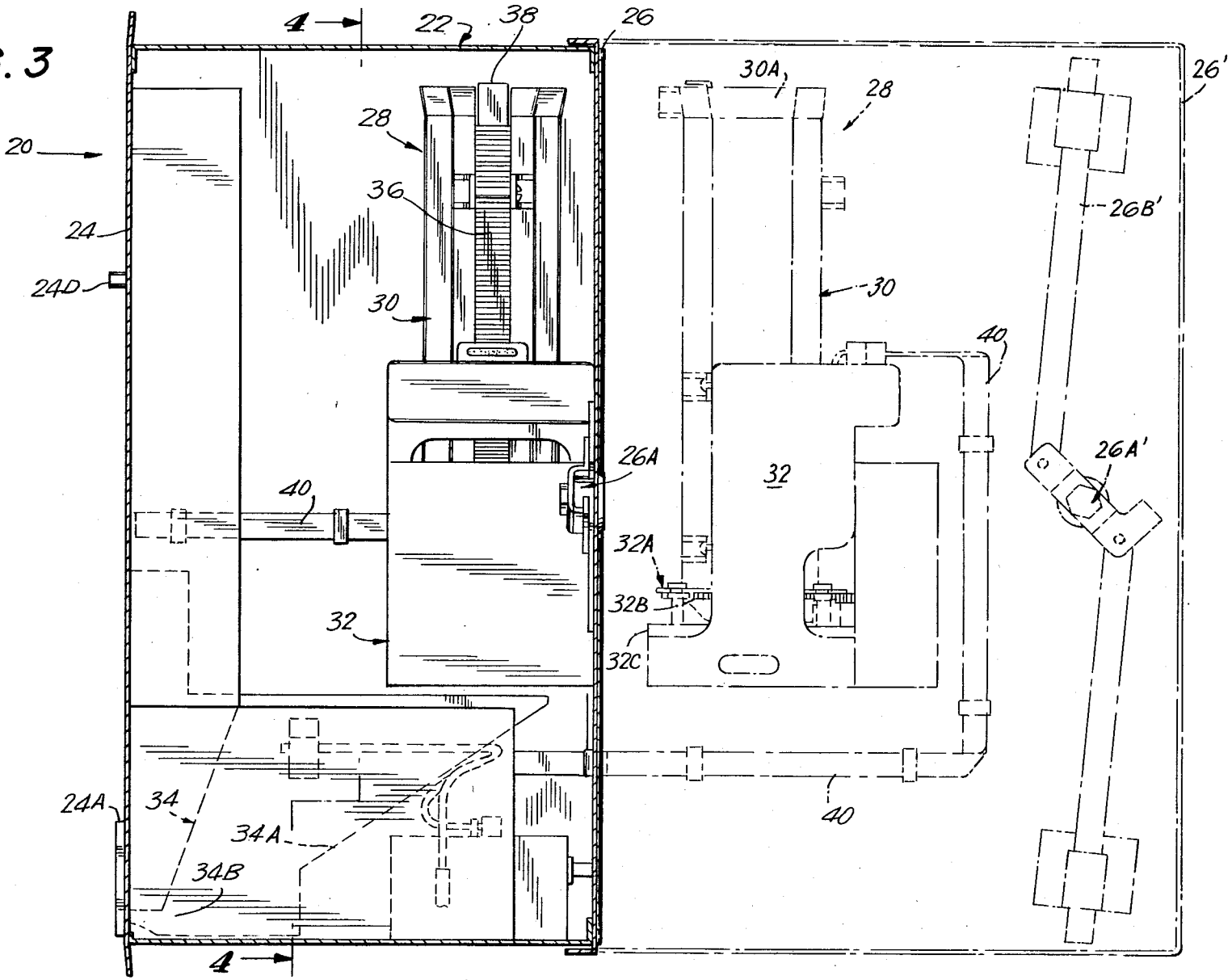
Figure 4:
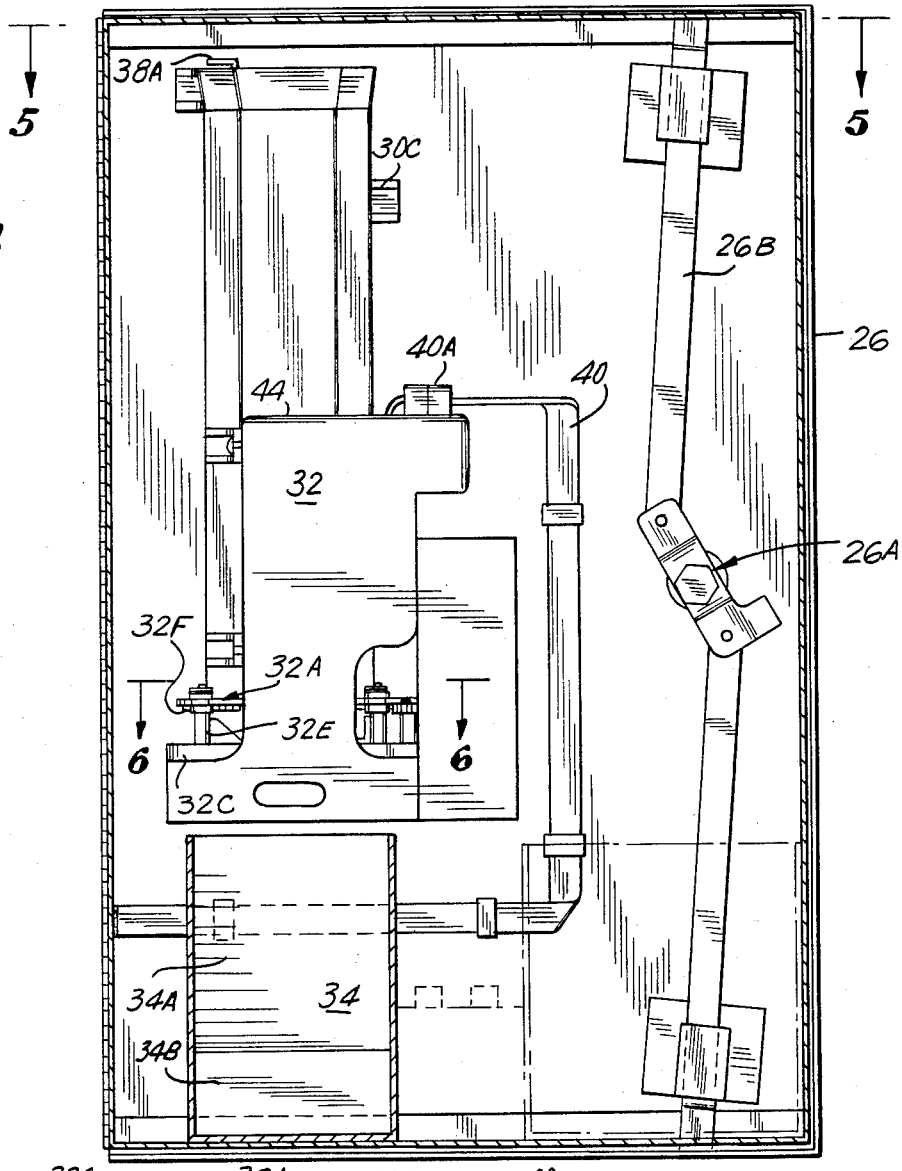
Figure 5:
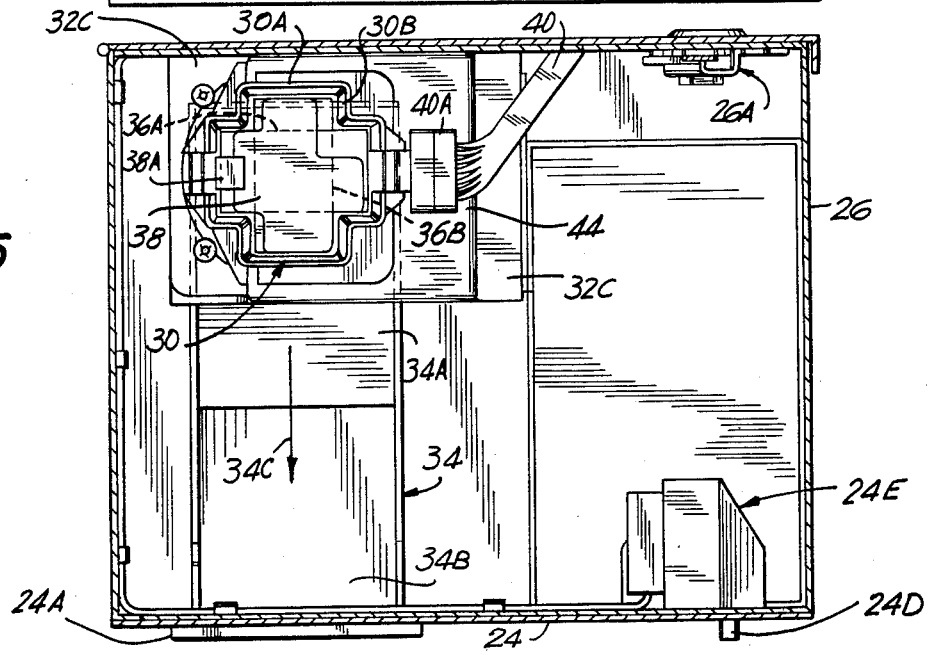
Figure 8:
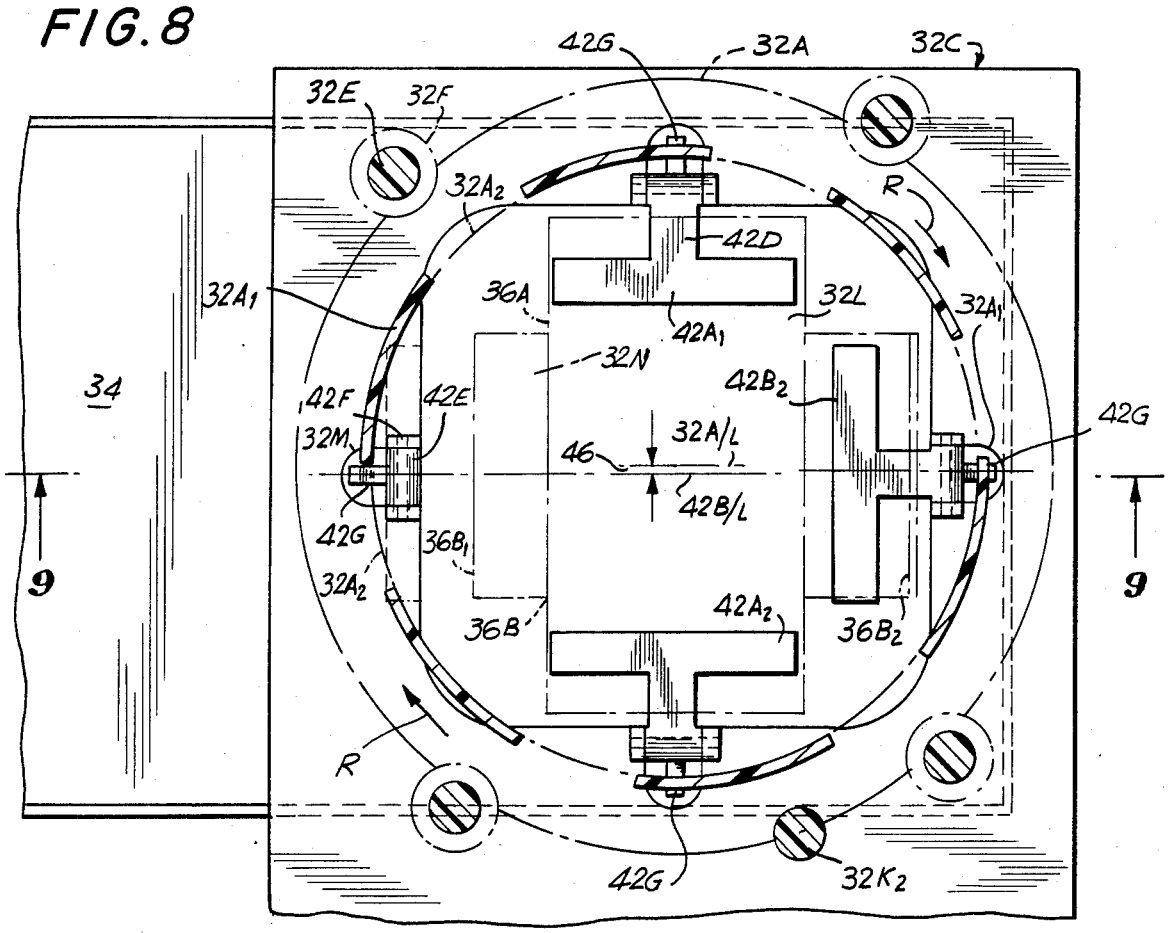
Figure 9:
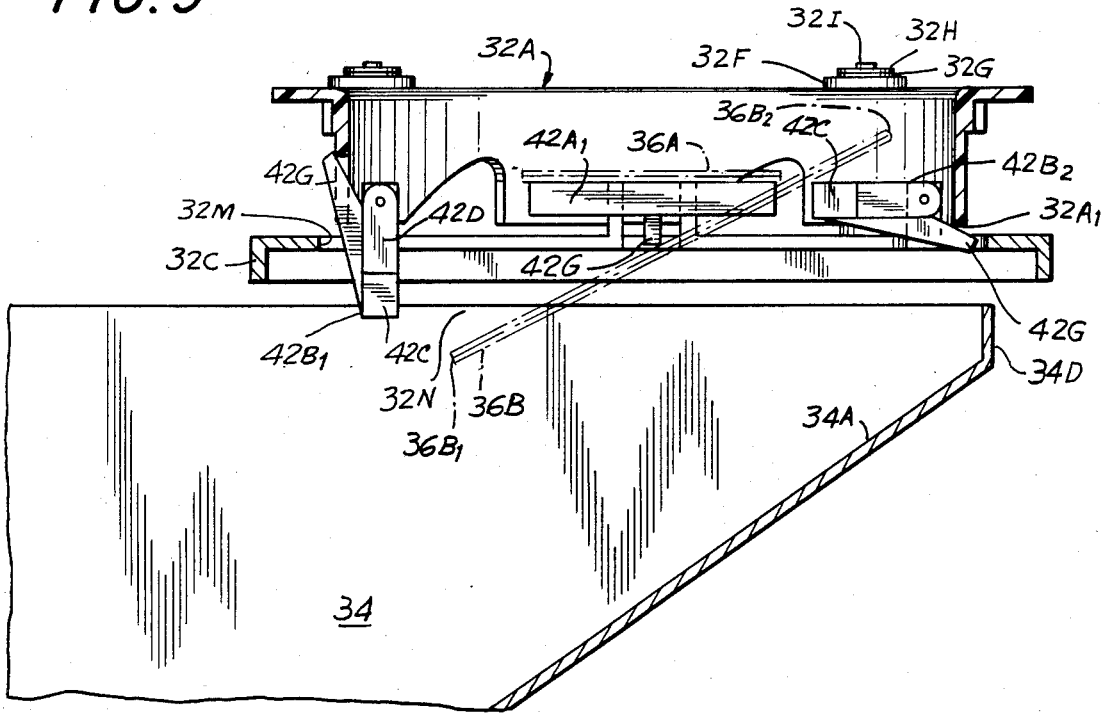
Figure 10:
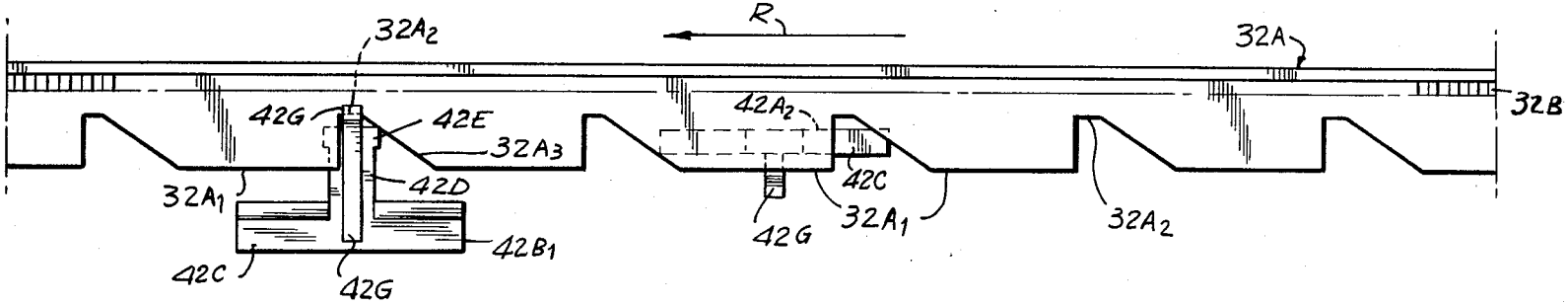
Figure 11:
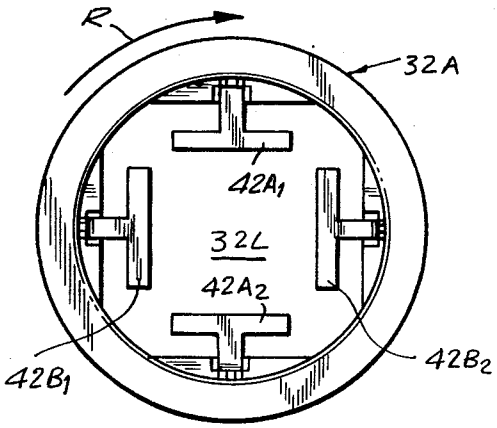
Figure 12:
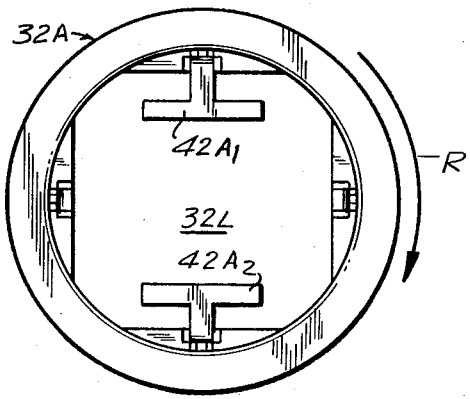
Figure 13:
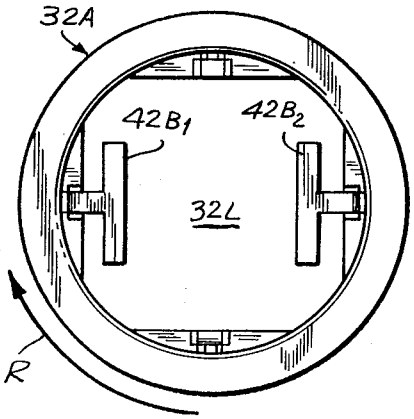

FIG. 3 is a cross-sectional view through the main housing, showing the interrelationship of the assembled magazine and dispensing mechanism mounted over the underlying chute and delivery area, generally in solid line at the left of the drawing figure, and indicating the open version showing the rear door illustrated in phantom with the portions mounted thereon also presented in phantom lines, generally taken along the plane defined by the line 3—3 of FIG. 1 in the direction of the arrows;

FIG. 4 is a cross-sectional view of the main housing of the equipment in the closed position showing the placement of the magazine, the dispensing mechanism and the chute delivery box, taken along the discontinuous section line 4—4 of FIG. 3 in the direction of the arrows;

FIG. 5 is a top plan view of the stacking magazine and its relationship in that view with the chute delivery box, taken from the line 5—5 of FIG. 4 in the direction of the arrows;

FIG. 6 is a cross-sectional plan view of the cam and gates of the invention, indicating the drive arrangement for the cam and the relative offset between the center lines of the cam and one pair of gates, taken along the line 6—6 of FIG. 4 in the direction of the arrows;

FIG. 7 is a cross-sectional view through the cam and one opposed pair of gates, both being shown in the up or support position for the stacked booklets above the gates, taken along the line 7—7 of FIG. 6 in the direction of the arrows;

FIG. 8 is a lower cross-sectional view through the cam, illustrating the alternating lobes and dwell positions of the cam as they encounter corresponding follower portions of the gates, causing one of the four gate members to drop down into the open bay in a preferred advance sequence to the others—this view is taken along the line 8—8 of FIG. 7 in the direction of the arrows;

FIG. 9 is a cross-sectional view through the cam and one pair of gates shown in FIG. 8, indicating the downward position of one of the two gates of that pair and the resultant preferred tipping of the corresponding booklet to be dispensed into the dispensing chute, taken along the line 9—9 of FIG. 8 in the direction of the arrows;

FIG. 10 is a stretched-out or layout view of the cam, showing one gate element in its preferred operating mode, whereby it drops down to release the end of the supported booklet while the gate is in the dwell position on the cam, with the next adjacent gate to be encountered in rotation (of the opposite pair) shown in the up or support position as its follower encounters the cam lobe;

FIG. 11 is a simplified schematic plan view of both pairs of gates in the up or support position to prevent jackpotting, which occurs after each dispensing cycle and prior to the next one;

FIG. 12 is a schematic plan view of a first dispensing cycle where the two opposed "horizontal" gate members are down because of their occupying the corresponding dwell positions on the cam, with the other pair gate members up and supporting a booklet (not shown); and FIG. 13 is a schematic plan view of the next cycle of operation, wherein the first pair of gates has resumed its support position, while the next pair of gates is now down to allow for the dispensing from the magazine of the next sequential stacked booklet in the criss-cross stack.

DETAILED DESCRIPTION

In considering the overall configuration of the equipment comprising this invention, the device 20 of FIG. 1 includes a main housing 22 and a front panel 24 having a plurality of functional mechanisms and openings. Thus, the stamp booklets to be dispensed by this invention and to be described below are delivered through opening 24A, with one such booklet 36A being shown in the dispensing area at that location. Also visible in FIG. 1 are a change return slot 24B, an exact change deposit slot 24C and a coin return activation button 24D. In its normal mode of operation, the unit has its rear door 26 both closed and locked, although for servicing and other access purposes, the phantom view of rear door 26' is shown indicating the manner of opening (see the directional arrow, also in phantom) in FIG. 1.

Figure 2:
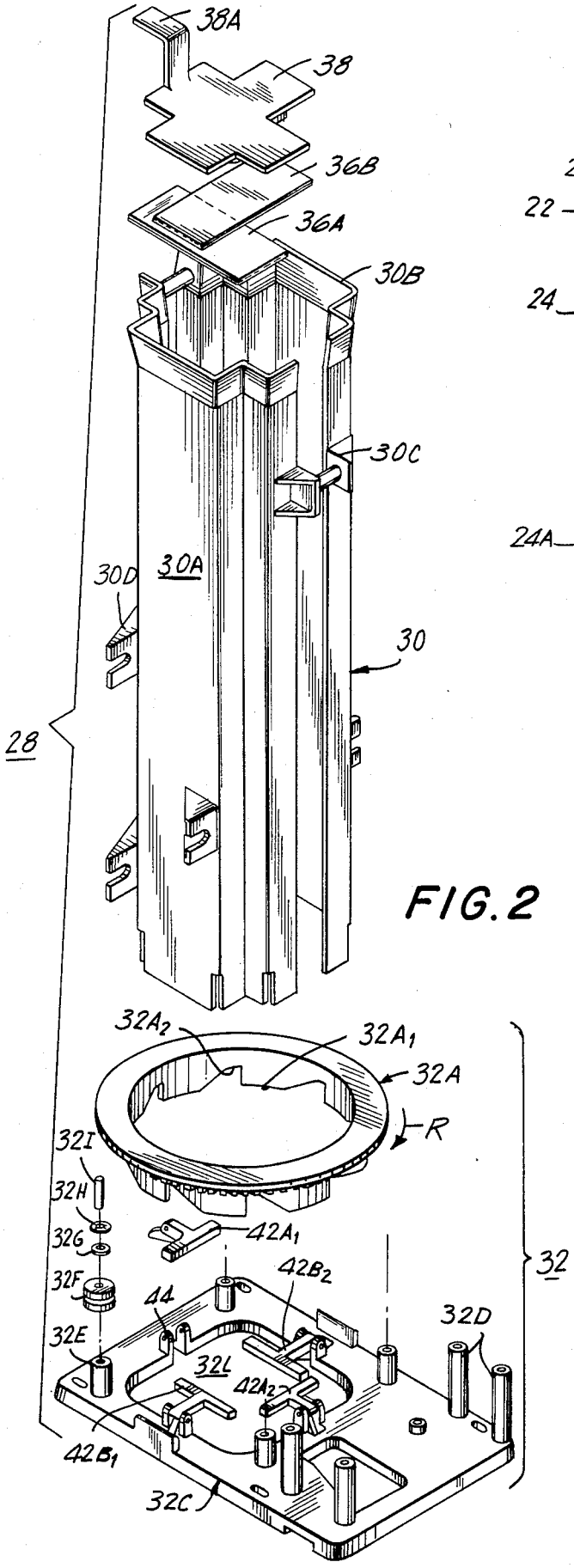
FIG. 2 is an exploded view of the interior of the dispenser, illustrating the booklet magazine, the cam, the gates and the base plate supporting the upper mechanism.

The internal components of the unit are best understood by considering the exploded view of FIG. 2 and the dual cross-sectional view of FIG. 3 (solid line and phantom portions) together. The entire dispensing mechanism is identified in FIG. 2 by the reference numeral 28 to the left, and consists, as principal components, of booklet magazine 30 and dispensing control mechanism 32; the latter includes cam 32A and supporting base plate 32C. Magazine 30 includes typical side panel 30A and upper flared lip 30B to accommodate the insertion of criss-cross booklets, such as are represented by perpendicular booklets 36A and 36B; such booklets may desirably be formed into a criss-cross stack by the technique and apparatus shown in copending application Ser. No. 668,204. When loaded, the booklets are kept in place by cruciform weight 38 which has elevated handle 38A for removal purposes. The magazine 30 is also provided with a pair of opposed sizing brackets 30C to allow for minor fit adjustments, as well as a conventional grouping of mounting brackets 30D for mounting magazine 30 to the housing (mounting not shown).

Considering the orientations ascertainable from the exploded view of FIG. 2 and from the solid line portion of FIG. 3, it will be seen that magazine 30 is disposed directly above cam wheel 32A, which, when operative, will rotate in accordance with the clockwise direction specified by directional arrow "R". Cam wheel 32A is provided with rest lobes $32A_1$ and operative "dwell" recesses $32A_2$, which will be described in greater detail hereinbelow.

THE CAM, GATES AND BASE PLATE

The interrelationship of cam 32A and the gates which actually allow booklets to be dispensed is based upon the mounting of the cam on base plate 32C, over cavity 32L, which is a generally square opening having rounded corners and which is blocked by the alternating and sequential presence therein of the gates to be described. By briefly referring to FIG. 6 as well, it will be appreciated that cam 32A is mounted to base plate 32C by means of attachment devices which affix the cam to mounting posts 32E (see one of such posts illustrated in FIG. 2, to which reference numerals have been applied). The main flange 32 A/F of cam 32A is held in the center of a split retainer ring 32F which permits the cam to rotate freely therethrough. The retainer ring is held in place, providing a loose but not snug fit to the cam flange, by means of shim 32G, retaining ring 32H and retaining pin 32I. This arrangement is the same for all four mounting posts at each of the four corners on which the cam is supported and therefore the description thereof need not be repeated.

At the lower left of FIG. 3, a general illustration of the underlying receiving mechanism for the dispensed booklets is indicated in hidden lines, being associated with booklet dispensing opening 24A on the front panel 24 of the unit (see FIG. 1). Thus, as a booklet is dispensed from unit 32, it drops down into chute/delivery area 34 and lands upon slanted surface 34A of the chute. Then, by further gravity action, the booklet (not shown in FIG. 3) is delivered into the delivery area 34B and will be accessible to a consumer reaching for the booklet from the opening 24A, which constitutes the delivery area at the front panel 24 of the machine.

Returning to the structure of base plate 32C as seen in FIG. 6, in addition to mounting posts 32D for the gear and idler motors (shown only generally in FIG. 6), two opposed pairs of gate members are illustrated, namely one opposed pair consisting of elements 42A$_1$ and 42A$_2$, and the opposite pair having elements 42B$_1$ and 42B$_2$. As illustrated at the bottom of FIG. 2, gate element 42A has been elevated above its mounting bracket 44 for ease of description, but it will of course be appreciated that its normal position is mounted in that bracket as the other three gate members are shown to be. With all four gate members in their extended or support positions, the central cavity area 32L is sufficiently bridged so that booklets dropping down from magazine 30 (although not shown in the lower portion of FIG. 2) will not drop through cavity 32L and reach the chute delivery area 34. Instead, one group of stacked booklets will be supported on gates 42A$_1$ and 42A$_2$, while the other group of prearranged booklets will be supported on opposed gate members 42B$_1$ and 42B$_2$, all in the manner to be described hereinafter.

THE BOOKLET MAGAZINE AND DISPENSING ASSEMBLY

The right-hand side of FIG. 3, showing the dispenser mechanism 32 and magazine 30 in phantom lines as they appear mounted on rear door 26', also indicates the presence of flat cable wiring 40 and the lever and bell crank type of door locking mechanism 26A' and 26B'. These phantom portions are shown in full line in the view of FIG. 4, which also adds the positioning, relative to dispenser mechanism 32, of chute/delivery box 34 beneath the dispenser. However, the locking mechanism and the wiring, and their mounting on the rear door 26, are generally conventional and need not be described any further in this application.

A further understanding of the orientation of the various components of this invention can be obtained from a consideration of the plan view of FIG. 5, which indicates the mounting of magazine 30 over base plate 32C of the dispenser mechanism. Viewed above the center of magazine 30, which also has side panels 30A and flared upper lip 30B, is auxiliary weight 38 and its handle 38A, installed above a stack of criss-crossed booklets of which two such members, 36A and 36B, are shown in hidden lines below weight 38. Aside from wiring 40 which connects into the cam operating members (not shown) through multi-pin receiving jack 40A mounted on surface 44, the dispensing direction from magazine 30 towards chute/delivery area 34 is indicated by the double headed arrow 34C—the first portion of that arrow indicates the hypothetical dropping of a booklet into the chute 34A, while the second portion of the arrow indicates the completion of the booklet's journey to dispensing and delivery area 34B, from which communication is had to front opening 24A on the front panel 24 of the machine.

The basic construction and operation of the dispensing mechanism is best understood from an initial consideration of FIGS. 6 and 7, which provide a general illustration of the normal positions of the gate members relative to the cam wheel. From this vantage point, the blocking of cavity 32L by the upward or support positions of opposed gate members is clear, since neither of the perpendicular openings required for the dropping down of one or the other of booklets 36A or 36B is present in an orientation that would allow such booklet's dispensing. Instead, one pair of gate members 42A$_1$ and 42A$_2$ support illustrative booklet 36A, while the opposed pair of gate members 42B$_1$ and 42B$_2$ support their corresponding booklet 36B.

Overall dispensing control is provided under the influence of gate cam 32A, which rotates in the clockwise direction indicated by the arrows "R" in response to a generally conventional gearing mechanism driven from main gear wheel 32J, which has a toothed drive wheel 32J$_1$ which meshes with teeth 32K$_1$ of idler wheel 32K. As indicated by the rotational arrows on each of drive and idler wheels 32J and 32K respectively, clockwise rotational motion is ultimately imparted by the meshing of cam teeth 32B and idler wheel teeth 32K$_1$. Drive wheel 32J is, in turn, driven by a gear motor (not shown) which is intermittently activated upon the insertion into the dispenser machine of the appropriately detected quantity of coins. Such coin activation mechanisms are conventional and are neither shown nor described in this application.

As cam 32A rotates, its upper flange 32A/F passes through the split opening in each of the four corner position retainer rings 32F, only one of which is numbered in FIG. 6. Each of the gate members of the two opposed pairs thereof is identically contructed and operates in generally similar fashion. Gate member 42B$_1$, at the left of FIG. 6, has been selected for description because it is the one which receives preferred dropping consideration in this particular sequence of operation, although that type of performance can be associated with any of the gate elements, depending upon their orientation and geometrical replacement. The main cross-piece of the gate consists of bar 42C, which is linked to the mounting hub 42E by center support shaft 42D. Each of the four gate elements is mounted on upstanding opposed brackets 44 and is mounted for rotation therethrough by means of pin 42F. The operative portion of each gate element, i.e., the structure which is acted upon by the cam itself, is rearwardly projecting "follower" element 42G, which is perhaps best illustrated in FIGS. 7 and 9. In this regard, when all of the gate members are in their up positions, supporting corresponding booklets 36A or 36B, the bar 42C and connecting portion 42D are arrayed horizontally, thus providing a substantially level support surface for the corresponding booklet. In order to achieve this position, the follower portion of the gate 42G must be in contact with the lobe 32A$_1$ of cam 32A—this is illustrated at the left of FIG. 7 with respect to gate member 42A$_1$ and at the right of that same figure with respect to gate element 42A$_2$.

ACTIVATION OF THE GATE PAIRS

In order to achieve a dropping operation with respect to any given dispenser booklet, follower portion 42G must drop into the upper dwell portion 32A$_2$ on the outline of cam 32A. Thus, considering the view of FIG. 7, if gate elements 42A$_1$ and 42A$_2$ were to drop down, the first of these clockwise and the second of these counterclockwise (thus providing a dispensing or dropping position for booklet 36A supported thereon), follower portion 42G would rise up into dwell opening 32A$_2$; this arrangement will ultimately be described below with respect to FIGS. 8 and 9.

In order to effectuate the preferred sequential operation of gate element 42B$_1$, so that proper dropping orientation for the "B" set of stacked booklets will be achieved as mentioned hereinabove, a differential or offset between the center lines of the cam 32A and one pair of gate members 42B$_1$, 42B$_2$ has been provided for in this invention. As illustrated in FIGS. 6 and 8, the center line of cam 32A, identified by reference numeral 32A/L, is offset by a dimension 46 (illustratively 0.030 inches) from the center line 42B/L of the "horizontal" pair of gate members 42B$_1$ and 42B$_2$. This offset can also be appreciated by an examination of the bar portions 42C of gate members 42B$_1$ and 42B$_2$ in FIG. 6. It will be noted that these bar portions 42C are not precisely centered with respect to the booklets resting on them, by virtue of the offset dimension 46 previously mentioned. (See space between bars 42C and the left and right ends of booklet 36B in FIG. 6.) This will ultimately result in one of the cam wheel dwell portions 32A$_2$ arriving at and activating one of the gate members slightly before the other, in this particular case referring to gate 42B1 being activated before gate 42B$_2$. This creates the desired preferred drop sequence for booklet 36B.

THE OPERATION OF THE "PREFERRED" GATE PAIR

A particular sequence of operation involving the preferred activation of gate element 42B$_1$ of the corresponding "B" pair of gates, can best be understood by a consideration of FIGS. 8 and 9, together with the various mechanical and operational components heretofore discussed. The cross-sectional plan view of FIG. 8, which is through the cam wheel 32A itself, but above the gate elements, illustrates the position just as gate 42B$_1$ has been activated and had dropped down out of sight; accordingly, the main portion of gate 42B$_1$, and specifically bar 42C and connecting rib 42D, are not visible in FIG. 8, since they have dropped down to the position indicated at the left in FIG. 9. To achieve this position, the clockwise rotation of cam 32A progresses from the point where its intermediate rest lobe 32A$_1$ has just passed the contact point with follower portion 42G of gate element 42B$_1$. When this occurs, the sharp vertical slope at the end of lobe 32A$_1$ allows follower 42G to move up into the cam dwell portion 32A$_2$, which thereby correspondingly drops main bar portion 42C of that gate down. This is accomplished by movement of follower 42G through rounded recess 32M of base plate 32C, whereby it ultimately comes in contact with the upper dwell portion 32A$_2$ of the cam. This establishes the orientation illustrated in FIGS. 8 and 9, whereby the absence of previously supporting gate 42B$_1$ creates a preferential dropping cavity 32N for the left end 36B$_1$ of booklet 36B to start dropping through.

At this particular moment in time, the opposite gate member of this pair, 42B$_2$, has not yet opened because its follower element 42G is still being held in contact with the trailing portion of lobe 32A$_1$ on the opposite side of the cam 32A (see right portions of FIGS. 8 and 9). In particular, that trailing portion of lobe 32A$_1$ has not yet cleared past follower portion 42G of gate element 42B$_2$ and consequently, that gate member is still horizontal, supporting the right end 36B$_2$ of booklet 36B. Accordingly, booklet 36B begins its tilting drop into chute/delivery area 34, as shown in FIG. 9. The forward upper edge of bar portion 42C of gate element 42B$_2$ acts as a fulcrum point for this tilting action of booklet 36B, as shown at the right of FIG. 9. When this preferred tilting sequence of operation has begun to occur, booklet 36B is caused to drop down onto chute 34A in the proper and virtually parallel mode indicated in FIG. 9, clearing the upper lip 34D of the chute 34, whereby it then slides down the chute 34A to the delivery area 34B (not shown in FIG. 9) and ultimately is removed through dispensing opening 24A in the front panel of the unit.

Shortly after the position illustrated in FIGS. 8 and 9 has been reached, the continued clockwise rotational movement of cam 32A causes the end of lobe 32A$_1$ at the right of FIG. 9 to pass by the follower element 42G of gate 42B$_2$. As a result, that gate element then drops down by virtue of its follower 42G moving up into dwell portion 32A$_2$ on the right side of cam 32A in FIG. 8. Gate 42B$_2$ then follows a generally identical pattern of movement to that already described with respect to gate 42B$_1$, and should there be any uncertainty in the movement of booklet 36B downward towards the chute, the dropping of the bar portion 42C of gate 42B$_2$ reinforces the initially introduced tilting action of booklet 36B. This, in effect, removes the last "obstacle" to the downward movement of booklet 36B and specifically allows end 36B$_2$ of that booklet to pass downward through opening 32L, thus completing the delivery of booklet 36B onto the chute 34A and ultimately into the customer's hands.

It will be noted that during this sequence of operation, involving the preferential dropping down of the gate 42B$_1$ and then the slightly time delayed dropping down of gate 42B$_2$, thereby delivering booklet 36B onto delivery chute 34A, the opposed pair of gates consisting of elements 42A$_1$ and 42A$_2$, has not moved at all. This is attributable to the continuous contact between their respective follower portions 42G and corresponding lobes 32A$_1$ which hold those followers in place as illustrated at the top and bottom of FIG. 8. That position for gate elements 42A$_1$ and 42A$_2$ also holds in the "vertical" stacking members, represented by lowermost booklet 36A, during this phase of the cycle. Until the next rotation of the cam has been completed, those two gate members will not drop down.

THE INTERMEDIATE SUPPORT POSITIONS OF ALL FOUR GATES

Moreover, once a dispensing cycle has been completed, each of the four gate elements is again maintained in its horizontal support position—this is the view shown in the illustration of FIG. 6 (and also FIG. 11 to be described below). This will provide, between each dispensing cycle, a full, four-gate element support position, so that between cycles, there is no chance that one stacked booklet in either direction will drop down accidentally or that indeed, the entire stacked load of booklets will somehow drop down accidentally. When viewed from the perspective of FIG. 8, it will be appreciated that after gate element 42B$_2$ has dropped down (as described above), the follower portions 42G of each of gate elements 42B$_1$ and 42B$_2$ gradually begin to return to their horizontal positions by following the angular path from the uppermost dwell position down to the lowermost horizontal lobe position. (This will best be appreciated from a consideration of FIG. 10). In so doing, and again following the clockwise rotation indicated by arrows "R" in FIG. 8, the dwell portions for each of gates 42B$_1$ and 42B$_2$ will end and the lobe portions following those dwell portions will again support the followers 42G of each of the initially operative pair of gate members 42B$_1$ and 42B$_2$. This will return all four gate members to the configuration illustrated in FIG. 6, i.e., where all four gates are up and in their supporting modes prior to the activation of the next dispensing cycle. When that next cycle does occur, it will simultaneously drop down the other pair of gate members 42A$_1$ and 42A$_2$, with no preferred sequence or tilting being involved because of the relative orientation of those two gates with respect to the underlying chute—when considering FIG. 9 in this regard, it will be noted that the dropping down of a lateral positioned booklet 36A, across the width of chute 34A, generally does not require any "extra" tilting action in order to insure the proper dropping of that booklet.

THE CAM PROFILE

A specific understanding of the geometric configuration of cam 32A can be gained from examining FIG. 10, which is a layout view of the cam, with all six dwell positions and corresponding lobe portions illustrated. The clockwise rotation of cam 32A is translated into a left pointing arrow "R" in FIG. 10, and each of the parts of the cam and the gates carry the same reference numerals as they did during the foregoing description.

The two gates which are illustrated in FIG. 10 are adjacent in the rotational sequence, namely gate 42B$_1$, which receives the preferred initialization treatment discussed above, and preceding gate 42A$_2$ in the rotation (i.e., the one which is to the right in FIG. 10 and which is 90° counterclockwise from gate 42B$_1$ in FIGS. 6 and 8). At the time shown in FIG. 10, the preferred tilting sequence has just occurred—thus, follower portion 42G has moved upward into the uppermost open portion of dwell section 32A$_2$, just barely having passed (in a right-to-left direction) the verical portion at the right end of lobe 32A$_1$. As a result of this cam movement, the main bar portion 42C and its connecting rib 42D have dropped into a vertical orientation to allow for the end 36B$_1$ of booklet 36B (not shown in FIG. 10, but see FIGS. 8 and 9) to drop down into the delivery cavity.

At the same time, gate element 42A$_2$ remains in its horizontal position, supporting booklet 36A (not shown in FIG. 10). This is attributable to the continuous contact of horizontal lobe portion 32A$_1$ and follower 42G of gate element 42A$_2$. At this same time, just after gate 42B$_1$ has dropped down, its counterpart 42B$_2$ is about to drop down and join it in a dispensing mode as described above. Similarly, the counterpart to gate 42A$_2$, namely gate 42A$_1$, remains horizontal and, together with gate 42A$_2$, continues to support booklet 36A in the horizontal and non-dispensing mode. But shortly after the position indicated in FIG. 10, the continued movement of cam 32A to the left begins to elevate gate members 42B$_1$ and 42B$_2$. This is accomplished by follower 42G moving downward along slanted surface 32A$_3$, which connects dwell portion 32A$_2$ with lobe portion 32A$_1$. Gradually, follower 42G moves along the slant surface 32A$_3$ and arrives at lobe portion 32A$_1$, returning gate 42B$_1$ to its horizontal position along with its counterpart, gate element 42B$_2$. In this posture, all four gate elements are now horizontal and are supporting both components criss-cross stack.

In considering the view of FIG. 10, while it is noted that there are six dwell portions 32A$_2$ and six corresponding lobe surfaces 32A$_1$, it should be appreciated that there are actually 12 dispensing cycles in one full rotation of cam 32A. This is based upon the fact that each of the dwell areas 32A$_2$ which achieves a dropping of a pair of gate elements, actually causes two droppings of a pair of gates in each cycle. Thus, the presence of six dwell portions and the existence of two pairs of gate "sets" throughout the cycle, results in a total of 12 dispensings per rotation.

In addition, the pairs of gates described above are only activated alternately, and with a total of 12 dispensings, each actuating point is only 30° apart out of a complete 360° of travel. In this respect, the gate cam need only travel 30° to obtain the next dispensing actuation, even though there are only six dwell and six lobe portions on the cam. This reduced travel and contact between the gates and the cam results in both longer life for the cam and in better control over the dispensing mechanism due to reduced operation of the cam, the followers and the motorized members.

THE ALTERNATING GATE POSITIONS

An overall schematic view of the different manners of operation of the gate pairs is given in simplified form in FIGS. 11–13. In the view of FIG. 11, cam 32A is simply illustrated as an annular member, superimposed over cavity area 32L. In that particular illustration, all four gate elements (42A$_1$ and 42A$_2$ in the "vertical" orientation and 42B$_1$ and 42B$_2$ in the "horizontal" orientation) are in their level supporting positions. Any booklets would therefore be maintained similarly level without any individual dispensing or multiple "jackpotting" occurring. As the cam rotates to the position of FIG. 12, following the clockwise rotation of arrow "R" in each view, gate pair 42B$_1$, 42B$_2$ has opened by the means discussed above, allowing corresponding booklet 36B (not shown) to drop down into cavity 32L. Continued rotation of cam 32A will then return the four gate elements to the positions shown in FIG. 11, before reaching that shown in FIG. 13. (This four-way closed position and how it occurs has already been described with respect to the interaction of lobe portions 32A$_1$ and follower portions 42G of the previously open gate pair.) Then, the orientation shown in FIG. 13 is ultimately arrived at, whereby "vertical" gate elements 42A$_1$ and 42A$_2$ will drop down as their followers enter the corresponding dwell positions, whereas the other opposed gate members 42B$_1$ and 42B$_2$ remain in their horizontal support positions for booklets 36B.

It has therefore been demonstrated that the present invention achieves a number of significant advantages in dispensing technology. In particular, the maximizing of dispensings per rotation of a cam controller is achieved by the particular interrelationship of cam followers and cam dwell and lobe portions. Significant cam savings in parts, service and labor are expected to be realized thereby. In addition, an intervening position whereby all four movable gate members continue to support corresponding booklets in a criss-cross stack between dispensing cycles is achieved, thereby preventing inadvertent dispensing and mass dropping of gravity-fed booklets. And finally, in order to minimize jamming of equipment and to insure proper sequential dropping of booklets oriented in a particular manner with respect to the delivery chute, an offset relationship between the center line of the cam and one particular pair of gate members causes one of that pair of gate members to drop down first, thereby insuring the proper delivery of those selectively oriented booklets.

It is to be understood that the above described embodiments are merely illustrative of the application of the principles of this invention. Numerous variations may be devised by those skilled in the art without departing from the spirit or scope of the invention.

We claim:

1. Apparatus for dispensing at least two articles of a predetermined configuration and arranged in a criss-cross stack, comprising a storage magazine for receiving said articles in the form of said stack, delivery means for furnishing selectively dispensed ones of said articles from said magazine on demand in response to an input command, receiving means for allowing said selectively dispensed articles to be removed from said apparatus, gate means for alternately blocking and opening access to said delivery means for said stack, dispensing control means for governing the operation of said gate means through at least opened and closed cycles, and locating means for effecting said opening of said gate means in response to said dispenser control means in a preferred sequence to cause one of said articles to be furnished to said delivery means in a predetermined orientation, wherein said gate means includes a plurality of pivotable members adapted for controlled movement relative to said delivery means, said pivotable members being operable in opposed pairs, said articles in said stack being supported by cooperating ones of said pivotable members in accordance with said predetermined configuration of said articles, said dispenser control means including means for positioning said pivotable members to support or release said articles in said closed or said opened cycles respectively, said articles in said stack including one group in a first position and another group in a second position, said one group being disposed in longitudinal alignment with said receiving means and said another group being disposed in transverse alignment with said receiving means, and said dispenser control means includes a control cam for governing the sequential movement of said pivotable members of said gate means, said locating means including portions of said gate means and of said dispenser control means to effect said delivery of said one of said articles in said predetermined orientation, wherein said control cam has a central axis and said gate means has a central axis between each opposed pair of said pivotable members, said locating means including an offset gap between said central axes of said control cam and said gate means, said control cam being substantially circular in configuration and including a plurality of lobe and dwell segments corresponding to said opened and close cycles respectively, and said pivotable members of said gate means including at least a crossbar portion to support said articles during alternate ones of said opened cycles and during said closed cycles, and a projecting follower portion in contact with said lobe segments to cause said gate means to open for the dispensing of selected ones of said articles and in contact with said dwell segments to cause said gate means to close to prevent the dispensing of said articles.

2. Apparatus in accordance with claim 1 wherein said control cam includes a depending flange having alternating peripheral regions corresponding to said lobe and said dwell segments, and disposed in said delivery means to sequentially contact said projecting follower portion of said pivotable members of said gate means.

3. Apparatus in accordance with claim 2 wherein said delivery means includes a central cavity, and said crossbar portions of said pivotable members selectively block and unblock said central cavity to correspond to said closed and opened cycles respectively, said closed cycle being defined by said crossbar portions of more than one pair of said pivotable members occupying said central cavity while the corresponding projecting follower portions of said pivotable members reside at said dwell segments, and said opened cycle being defined by said crossbar portions of no more than one pair of said pivotable members occupying said central cavity while the corresponding projecting follower portions of said pivotable members reside in said lobe segments.

4. Apparatus in accordance with claim 3 wherein said crossbar portions of one opposed pair of said pivotable members in said opened cycle support at least one of said articles in said one group or said another group, and said crossbar portions of another of said opposed pairs of said pivotable members in said opened cycle unblock said central cavity to allow passage of one of said articles through said delivery means to said receiving means.

5. Apparatus in accordance with claim 3 wherein said crossbar portions of at least two opposed pairs of said pivotable members in said closed cycle support at least one of said articles in said one group and at least one of said articles in said another group, whereby said central cavity is blocked to prevent passage of said articles to said receiving means.

6. Apparatus in accordance with claim 3 wherein said lobe segments comprise a plurality of indented cut-outs in said depending flange and said dwell segments comprise of plurality of substantially flat areas on said peripheral regions.

7. Apparatus in accordance with claim 6 wherein said plurality of said cut-outs and said flat areas alternate in pairs on said depending flange.

8. Apparatus in accordance with claim 3 wherein said receiving means includes at least a delivery chute having a lip for receiving said articles from said delivery means during said opened cycles, said lip being substantially parallel to said another group of said articles and substantially perpendicular to said one group of said articles, and said offset gap accommodates said projecting follower portion of one of said pivotable members having a longitudinal alignment within one of said lobe segments prior to the accommodation of said projecting follower portion of the other corresponding one of said pivotable members having a longitudinal alignment within another one of said lobe segments.

9. Apparatus in accordance with claim 8 wherein said predetermined configuration of said articles is rectangular, with a long and a short edge, and wherein said predetermined orientation of said one of said articles to be delivered includes one of said articles in said longitudinal alignment with one of said short edges positioned beyond said lip and above said delivery chute.

10. Apparatus in accordance with claim 9 wherein the other of said short edges of the delivered one of said articles is initially on said crossbar portion of said pivotable member while the corresponding one of said projecting follower portions thereof is not yet accommodated in said another one of said lobe segments, said other of said short edges being released from said crossbar portion to complete said delivery when said projecting follower portion becomes accommodated in said another of said lobe segments.

* * * * *